US010306960B2

(12) United States Patent
Patterson

(10) Patent No.: US 10,306,960 B2
(45) Date of Patent: Jun. 4, 2019

(54) MAGNETIC UMBRELLA HOLDER OR HANDLE

(71) Applicant: Omari Patterson, Charlotte, NC (US)

(72) Inventor: Omari Patterson, Charlotte, NC (US)

( * ) Notice: Subject to any disclaimer, the term of this patent is extended or adjusted under 35 U.S.C. 154(b) by 0 days.

(21) Appl. No.: 15/989,110

(22) Filed: May 24, 2018

(65) Prior Publication Data

US 2018/0338592 A1 Nov. 29, 2018

Related U.S. Application Data

(60) Provisional application No. 62/510,743, filed on May 24, 2017.

(51) Int. Cl.
*A45B 25/00* (2006.01)

(52) U.S. Cl.
CPC ..... *A45B 25/00* (2013.01); *A45B 2200/109* (2013.01)

(58) Field of Classification Search
CPC ..... A45B 25/00; A45B 2200/109; A45B 9/02; A45B 2200/1081; A47G 25/12
USPC ..... 135/16; 248/537, 206.5
See application file for complete search history.

(56) References Cited

U.S. PATENT DOCUMENTS 2,888,617 A * 5/1959 Baumet ..... H01F 7/0252 248/206.5
5,150,728 A 9/1992 Stark
5,385,161 A 1/1995 Loker et al.
5,529,368 A 6/1996 Cui et al.
5,727,583 A 3/1998 Kennedy
6,223,759 B1 * 5/2001 Flippin, Jr. ..... A45B 5/00 135/16
6,959,715 B2 11/2005 Siegel
7,377,474 B2 * 5/2008 Curtis ..... E01F 9/681 248/165
7,967,274 B1 6/2011 Stallings, Jr. et al.
8,714,511 B2 * 5/2014 Zoeteman ..... A45B 23/00 135/16
8,726,921 B2 5/2014 Wilkins
9,321,336 B2 4/2016 Sasaki
2002/0139403 A1 10/2002 Shi
2011/0265836 A1 * 11/2011 Wilkins ..... A45B 3/02 135/16
2012/0168598 A1 7/2012 Walker et al.
2013/0256355 A1 10/2013 Gatto-Weising
2013/0292534 A1 * 11/2013 O'Donohue ..... A47G 25/12 248/346.04

(Continued)

FOREIGN PATENT DOCUMENTS

WO WO-2016085078 A1 * 6/2016 ..... A45B 3/00

*Primary Examiner* — Noah Chandler Hawk
(74) *Attorney, Agent, or Firm* — Jeffrey C. Watson; Matthew L. Grell; Grell & Watson Patent Attorneys LLC

(57) ABSTRACT

A magnetic umbrella holder includes a base and a magnet. The base is configured to hold an umbrella. The magnet is positioned at the bottom of the base. The magnet is configured to hold the base perpendicular to a magnetic surface. The base includes a hollow interior, a closed end, and an open end. The hollow interior is configured to hold a handle of the umbrella. The closed end houses the magnet. The open end is configured for allowing the handle of the umbrella to be inserted inside the hollow interior. Wherein, the magnetic umbrella holder is configured for positioning an umbrella perpendicular on the magnetic surface.

20 Claims, 14 Drawing Sheets

(56) References Cited

U.S. PATENT DOCUMENTS

| | | | | |
|---|---|---|---|---|
| 2015/0305453 | A1* | 10/2015 | Gatto-Weising | A45B 11/00 248/516 |
| 2017/0055651 | A1* | 3/2017 | Ho | A45B 9/02 |
| 2018/0126914 | A1* | 5/2018 | Ferreri | B62B 9/147 |

* cited by examiner

MAGNETIC UMBRELLA HOLDER OR HANDLE

CROSS-REFERENCE TO RELATED APPLICATIONS

This application claims benefit of priority application, U.S. Provisional Ser. No. 62/510,743 filed on May 24, 2017 entitled "Magnetic Umbrella Holder or Handle", which is incorporated herein by reference in its entirety.

FIELD OF THE DISCLOSURE

The present disclosure is directed to umbrellas and holders for umbrellas for protection from the rain, sun, or other elements. More specifically, the instant disclosure is directed to a magnetic holder or handle for umbrellas for holding an umbrella on a metal surface for protection from the rain, sun, or other elements.

BACKGROUND

An umbrella or parasol is a folding canopy supported by wooden or metal ribs, which is usually mounted on a wooden, metal, or plastic pole. An umbrella may also be called a brolly (UK slang), parapluie (nineteenth century, French origin), rainshade, gamp (British, informal, dated), or bumbershoot (American slang). Umbrellas are commonly designed to protect a person against rain or sunlight. The word "umbrella" typically refers to a device used for protection from rain. The word parasol usually refers to an item designed to protect from the sun. Often the difference is the material used for the canopy, as some parasols are not waterproof. Umbrella canopies may be made of fabric or flexible plastic.

Umbrellas and parasols are primarily hand-held portable devices sized for personal use. The largest hand-portable umbrellas are golf umbrellas. Umbrellas can be divided into two categories: fully collapsible umbrellas, in which the metal pole supporting the canopy retracts, making the umbrella small enough to fit in a handbag; and non-collapsible umbrellas, in which the support pole cannot retract and only the canopy can be collapsed. Another distinction can be made between manually operated umbrellas and spring-loaded automatic umbrellas which spring open at the press of a button. Hand-held umbrellas have some type of handle, either a wooden or plastic cylinder or a bent "crook" handle (like the handle of a cane).

One problem that has been discovered with the use of umbrellas is that they require a free hand to operate or to maintain in a position over the user. As such, the umbrella user is limited in the things they can do and places they go, while still being able to operate the umbrella. For example, the instant disclosure recognizes that in rainy conditions when a user enters or exits an automobile, or the like, the user must put down the umbrella to enter and exit the vehicle, thereby exposing themselves to the rain. This situation is even more problematic when the user must load or unload something from the vehicle, like groceries or even a child, like a toddler in a car seat, where the user must fasten the child in the car seat while standing in the rain. As such, there is clearly a need to provide an umbrella holder that is configured to position the umbrella over the user while entering and exiting a vehicle.

As another example, the instant disclosure recognizes that using an umbrella with devices like shopping carts, golf carts, push carts, the like, etc., is difficult as the devices may require a user to use their hands for operation and/or would be more user friendly if the user had both hands free for operation. As such, there is clearly a need to provide an umbrella holder that is configured to position the umbrella over the user while operating a device like a shopping cart, a golf cart, a push cart, the like, etc.

Currently, in the field of magnetic umbrella holders there are no known existing products or services that securely position an umbrella on a metal surface.

The instant disclosure is designed to address at least certain aspects of the problems or needs discussed above by providing a magnetic umbrella holder or handle.

SUMMARY

Accordingly, in one aspect, the present disclosure embraces a magnetic umbrella holder. The magnetic umbrella holder generally includes a base and a magnet. The base may be configured to hold an umbrella. The magnet may be positioned at the bottom of the base. The magnet may be configured to hold the base perpendicular to a magnetic surface. The base may include a hollow interior, a closed end, and an open end. The hollow interior may be configured to hold a handle of the umbrella. The closed end may house the magnet. The open end may be configured for allowing the handle of the umbrella to be inserted inside the hollow interior. Wherein, the magnetic umbrella holder is configured for positioning an umbrella perpendicular on the magnetic surface. Whereby, when the umbrella is inserted into the base and the base is positioned on the magnetic surface, the magnetic umbrella holder may hold the umbrella perpendicular on the magnetic surface.

One feature of the instant magnetic umbrella holder may be that the open end and hollow interior may be sized and configured to receive and hold various size and shapes of umbrella handles. In select embodiments, the open end and hollow interior may be sized and configured to receive and hold various size and shapes of pole shaped umbrella handles. In other select embodiments, the open end and hollow interior may be sized and configured to receive and hold various size and shapes of crook shaped umbrella handles. In other select embodiments, the open end and hollow interior may be sized and configured to receive and hold various size and shapes of pole shaped umbrella handles and various size and shapes of crook shaped umbrella handles.

In select embodiments of the instant magnetic umbrella holder, the base may include a side hole. The side hole may be configured for receiving a crook shaped umbrella handle. The side hole may also be positioned for accessing the automatic button for automatic opening umbrellas.

In select embodiments of the instant magnetic umbrella holder, the hollow interior of the base may have a tubular shape. The tubular shape of the hollow interior may include a plurality of gripping ribs. The gripping ribs may run radially around the hollow interior and may be longitudinally spaced from one another.

Another feature of the instant magnetic umbrella holder may be that the base can be made from a flexible material. The flexible material may be configured to compress and hold various size or shaped umbrella handles. As an example, and clearly not limited thereto, the flexible material may have a hardness of approximately or equal to 70 durometers.

Another feature of the instant magnetic umbrella holder may be that the magnet can have a pull force configured to hold the umbrella perpendicular on the magnetic surface.

In select embodiments of the instant magnetic umbrella holder, the magnet may be positioned in a bottom partition. The bottom partition may be on a top of the closed end of the base. The bottom partition may be sized and configured to receive and hold the magnet on the top of the closed end.

In select embodiments of the instant magnetic umbrella holder, the base may include a first side piece, a second side piece, a bottom piece and a top ring. The first side piece and the second side piece may be configured to connect together to form the hollow interior. The bottom piece may form the closed end on a bottom of the base. The bottom piece may include the bottom partition configured to receive and hold the magnet on a top of the bottom piece. The top ring may be configured to form the open end on a top of the connected first side piece and second side piece.

Another feature of the instant magnetic umbrella holder may be the inclusion of a removable handle insert. The handle insert may be configured to be removably inserted into the open end of the base. The handle insert may include a lip configured to rest on the open end of the base. In select embodiments, the handle insert may include a tapered interior with longitudinal ribs configured to grip the handles. In other select embodiments, the handle insert may include a reduced interior configured to hold smaller handles than the hollow interior of the base. In other select embodiments, the handle insert may be configured to hold crook shaped handles.

Another feature of the instant magnetic umbrella holder may be that, in select embodiments, the base may include an exterior. The exterior may include grips configured for gripping the base for transportation and/or removal from the magnetic surface.

In another aspect, the instant disclosure embraces a magnetic umbrella handle. The magnetic umbrella handle may include an umbrella handle with a magnet permanently built into the bottom, or it may include the instant magnetic umbrella holder inserted over the end of the umbrella handle for providing the magnet at the bottom of the umbrella handle. As such, the instant magnetic umbrella handle may generally include a handle attached to an umbrella configured for holding the umbrella, and a magnet positioned at a bottom of the handle. The magnet may be configured to hold the handle perpendicular to a magnetic surface. Wherein, the magnetic umbrella handle may be configured for positioning an umbrella perpendicular on the magnetic surface. Whereby, when the umbrella is positioned on the magnetic surface, the magnetic umbrella handle holds the umbrella perpendicular on the magnetic surface.

One feature of the magnetic umbrella handle may be that the magnet can have a pull force configured to hold the umbrella perpendicular on the magnetic surface.

Another feature of the instant magnetic umbrella handle may be that the handle can include an exterior with grips configured for gripping the handle for transportation and removal from the magnetic surface.

In yet another aspect, the instant disclosure embraces a method of holding an umbrella over a magnetic surface. The instant method may generally include the step of providing the instant magnetic umbrella holder in any of the embodiments shown and/or described herein. As such, the provided magnetic umbrella holder may generally include a base and a magnet. The base may be configured to hold an umbrella. The magnet may be positioned at the bottom of the base. The magnet may be configured to hold the base perpendicular to a magnetic surface. The base may include a hollow interior, a closed and, and an open end. The hollow interior may be configured to hold a handle of the umbrella. The closed end may house the magnet. The open end may be configured for allowing the handle of the umbrella to be inserted inside the hollow interior. As a result of the provided magnetic umbrella holder, the method may include the step of positioning the umbrella perpendicular on the magnetic surface.

In select embodiments of the instant method of holding an umbrella over a magnetic surface, the step of positioning the umbrella perpendicular on the magnetic surface may include the steps of: attaching the base perpendicular on the magnetic surface via the magnet on the closed end of the base; and inserting the handle of the umbrella inside the hollow interior of the base.

In other select embodiments of the instant method of holding an umbrella over a magnetic surface, wherein the magnetic surface is the roof of a car, whereby the step of positioning the umbrella perpendicular on the magnetic surface may include the step of positioning the umbrella perpendicular on the roof of the car.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present apparatuses, systems and methods will be better understood by reading the Detailed Description with reference to the accompanying drawings, which are not necessarily drawn to scale, and in which like reference numerals denote similar structure and refer to like elements throughout, and in which.

Figure 1:
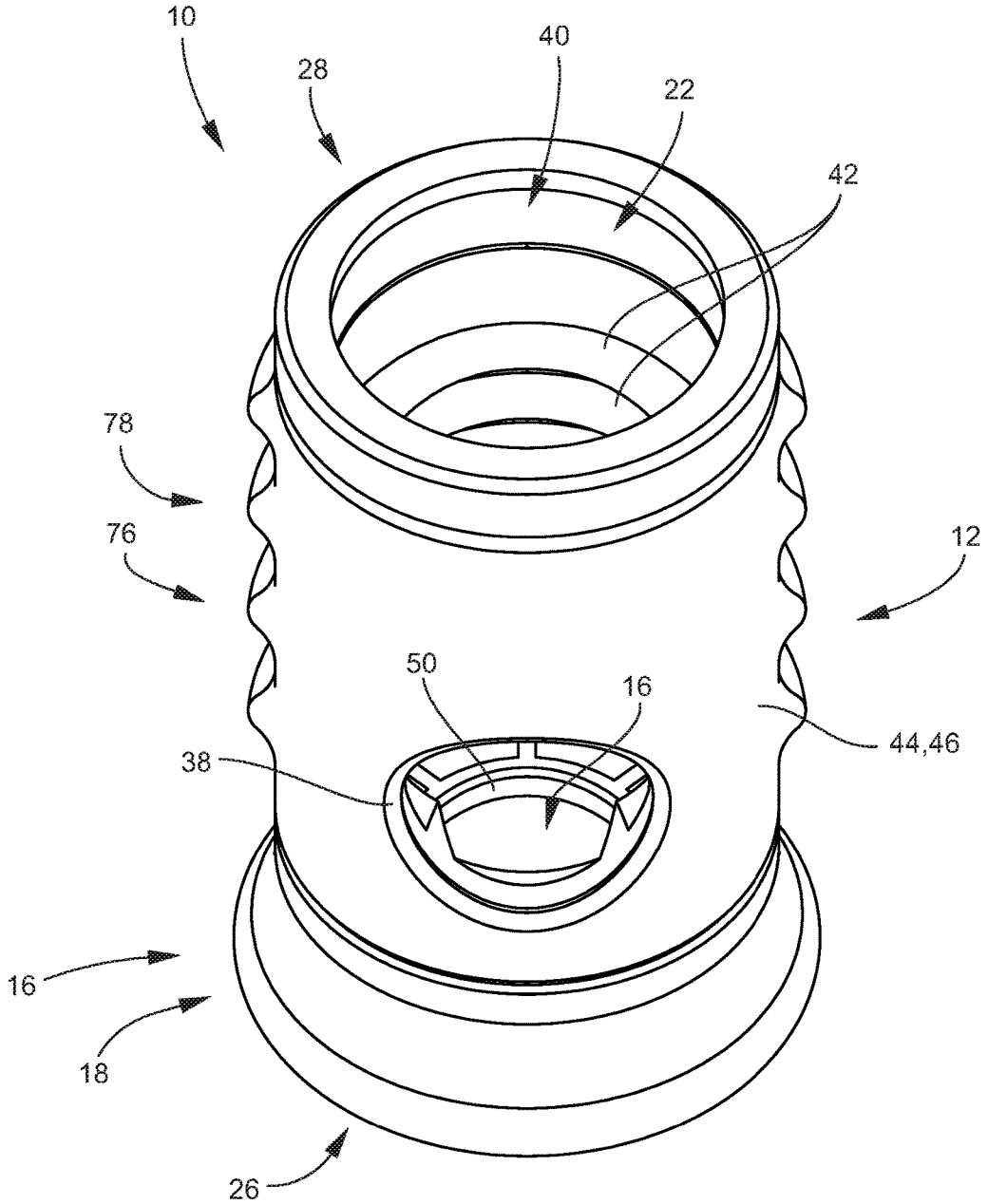
FIG. 1 is a top perspective view of the magnetic umbrella holder according to select embodiments of the instant disclosure.
Figure 2:
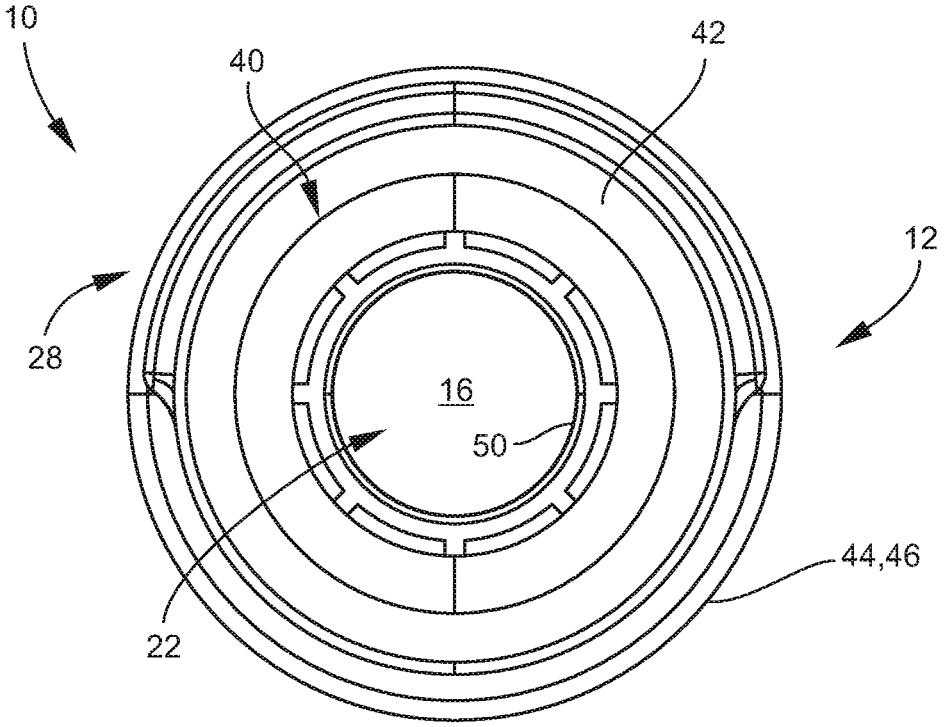
FIG. 2 is a top view of the magnetic umbrella holder from FIG. 1.
Figure 3:
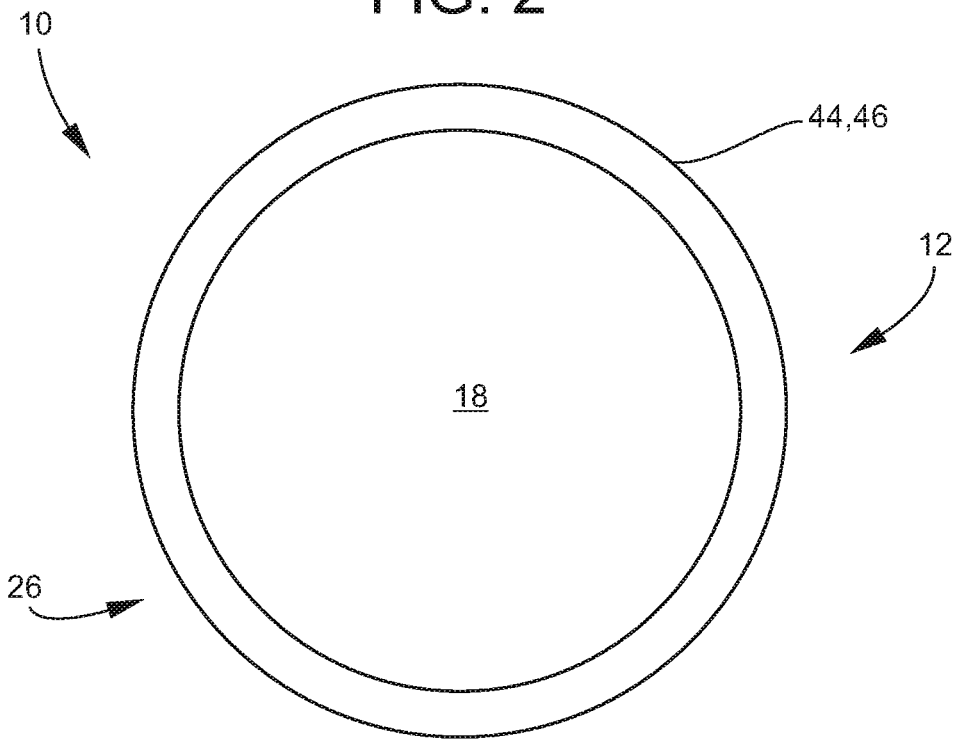
FIG. 3 is a bottom view of the magnetic umbrella holder from FIG. 1.
Figure 4:
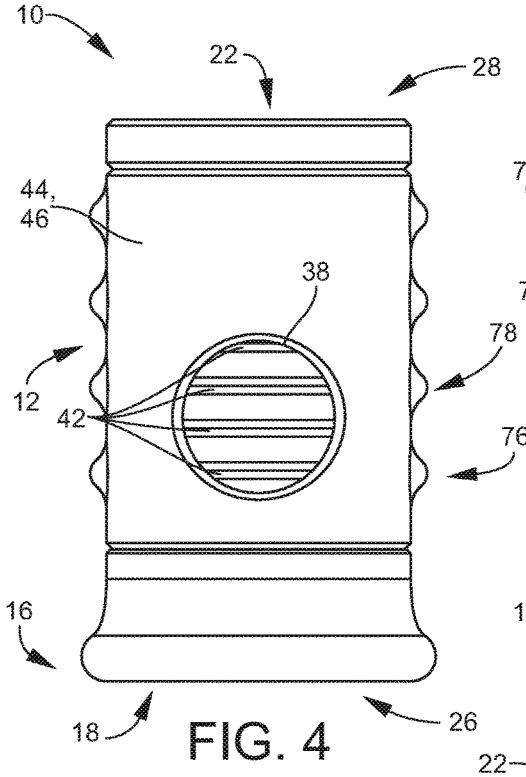
FIG. 4 is a front view of the magnetic umbrella holder from FIG. 1.
Figure 5:
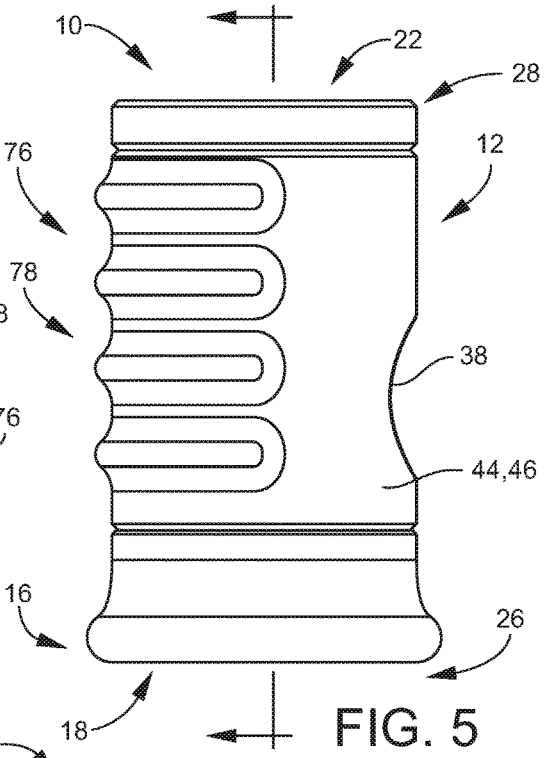
FIG. 5 is a side view of the magnetic umbrella holder from FIG. 1.
Figure 6:
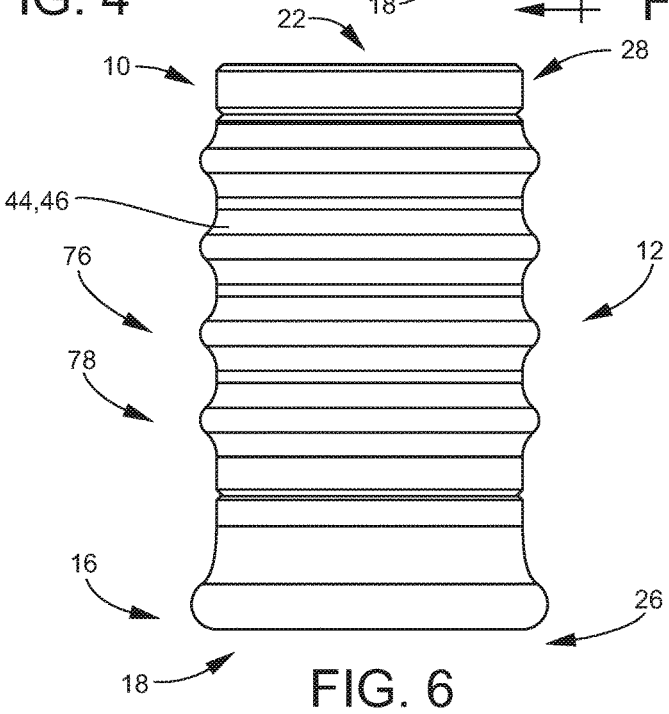
FIG. 6 is a rear view of the magnetic umbrella holder from FIG. 1.
Figure 7:
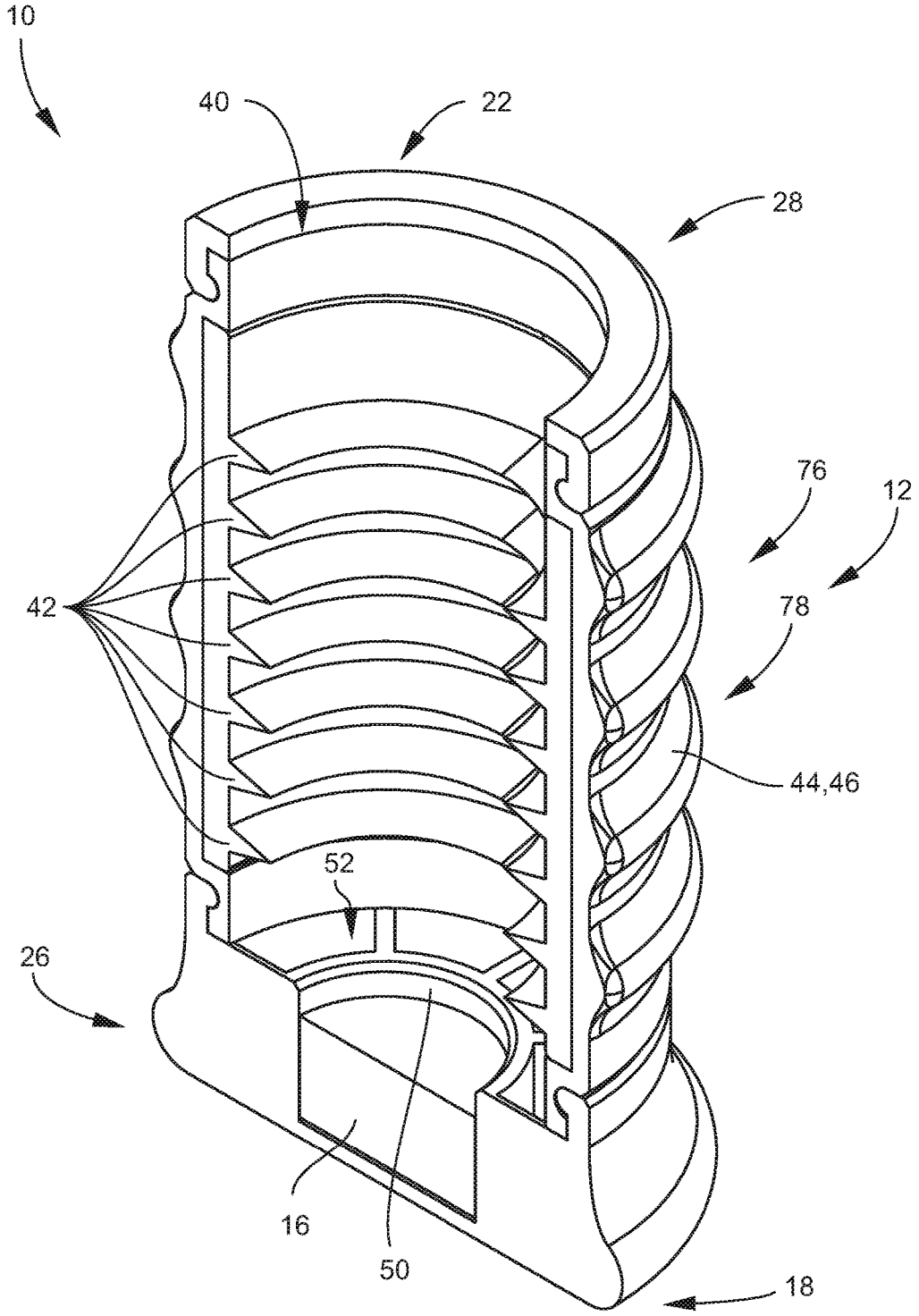
FIG. 7 is a cross-sectional view of the magnetic umbrella holder from FIG. 1 taken from the cross-section shown in FIG. 5.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-20, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-19, in a possibly preferred embodiment, the present disclosure overcomes the above-mentioned disadvantages and meets the recognized need for such an apparatus or method by providing of magnetic umbrella holder 10. Magnetic umbrella holder 10 may be for holding or positioning umbrella 14 on magnetic surface 20. Magnetic umbrella holder 10 may generally include base 12 and magnet 16. Base 12 may be for securing umbrella 14 via its handle 24 in magnetic umbrella holder 10. Magnet 16 may be for securing magnetic umbrella holder 10 onto magnetic surface 20. As such, base 12 may be configured to hold umbrella 14. Magnet 16 may be positioned at bottom 18 of base 12. Magnet 16 may be preferably, but is not limited to, configured to hold base 12 perpendicular to magnetic surface 20, as represented by perpendicular orientation 30.

Base 12 may be included with magnetic umbrella holder 10. Base 12 may be designed and configured for holding umbrella 14, including various size and shapes of handles 24 for umbrella 14. Base 12 may include hollow interior 22, closed end 26, and open end 28. Hollow interior 22 may be configured to hold handle 24 of umbrella 14. Closed end 26 may house magnet 16. Open end 28 may be configured for allowing handle 24 of umbrella 14 to be inserted inside hollow interior 22 of base 12. Wherein, magnetic umbrella holder 10 may be configured for positioning umbrella 14 perpendicular on magnetic surface 20. Whereby, when umbrella 14 is inserted into open end 28 into hollow interior 22 of base 12 and base 12 is positioned on magnetic surface 20 via magnetic pull force 48 of magnet 16, magnetic umbrella holder 10 may hold umbrella 14 perpendicular or upright on magnetic surface 20, as shown in FIGS. 13, 14, 16, 17, 18 and 19.

Figure 19:
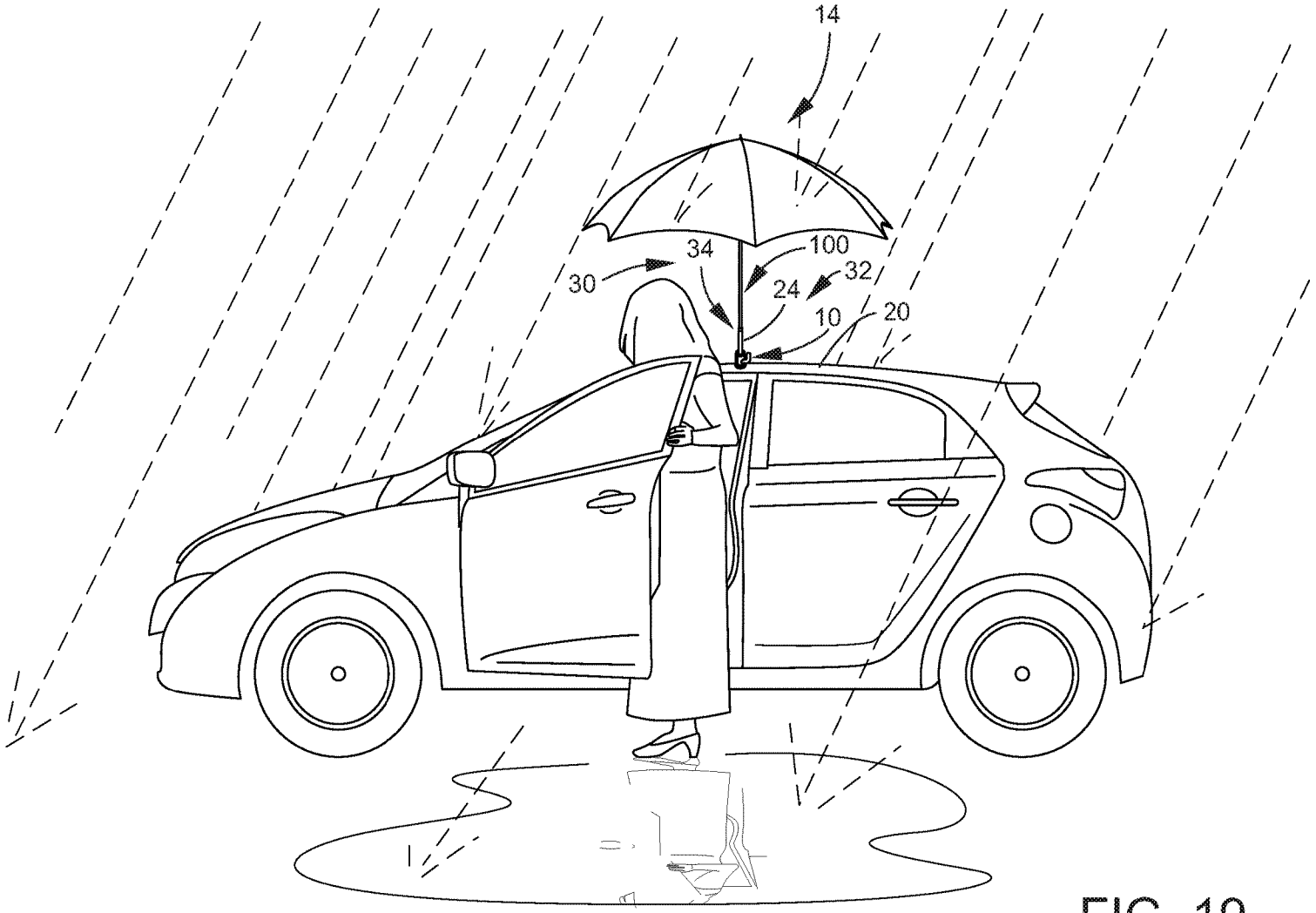
FIG. 19 is an environmental side view of the magnetic umbrella holder according to select embodiments of the instant disclosure positioned on the magnetic surface or roof of a car and holding the umbrella over the user while entering the car.

Magnetic surface 20 may be any magnetic surface, or surface that magnet 16 provides pull force 48 configured for securing magnetic umbrella holder 10 with umbrella 14 thereto. As such, magnetic surface 20 may include any metal surfaces or the like. As an example, as shown in FIG. 19, magnetic surface 20 may be the roof of a car (or other surface on a car), for providing cover under umbrella 14 for the driver and/or passengers for entering, exiting, loading, securing children, the like, etc. However, the disclosure is not so limited, and magnetic umbrella holder 10 may be used for securing umbrella 14 over or on any magnetic surface 20, including, but not limited to, golf carts, shopping carts, the like, etc.

Figure 13:
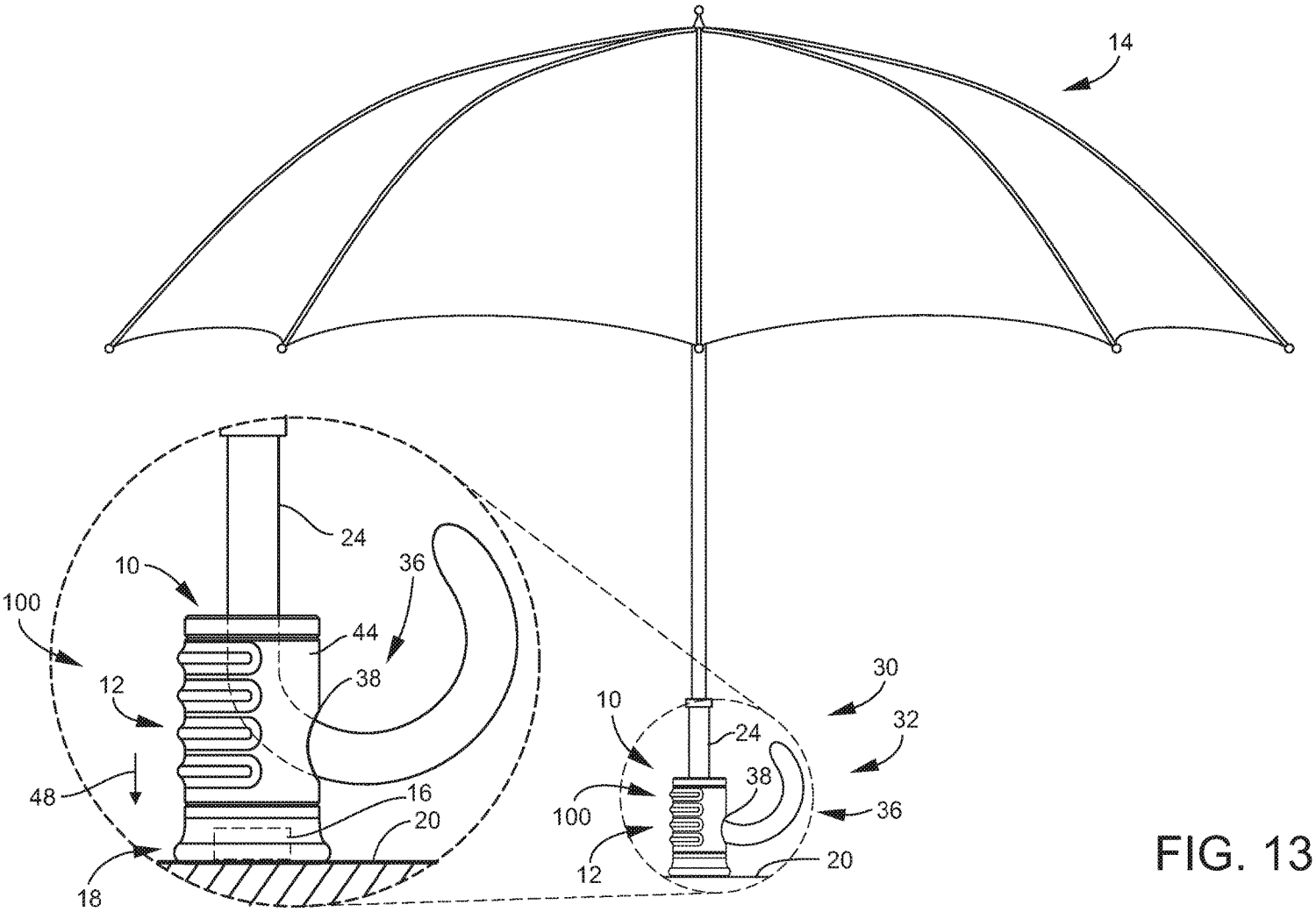
FIG. 13 is an environmental side view of the magnetic umbrella holder according to select embodiments of the instant disclosure holding an umbrella with a crook handle.
Figure 14:
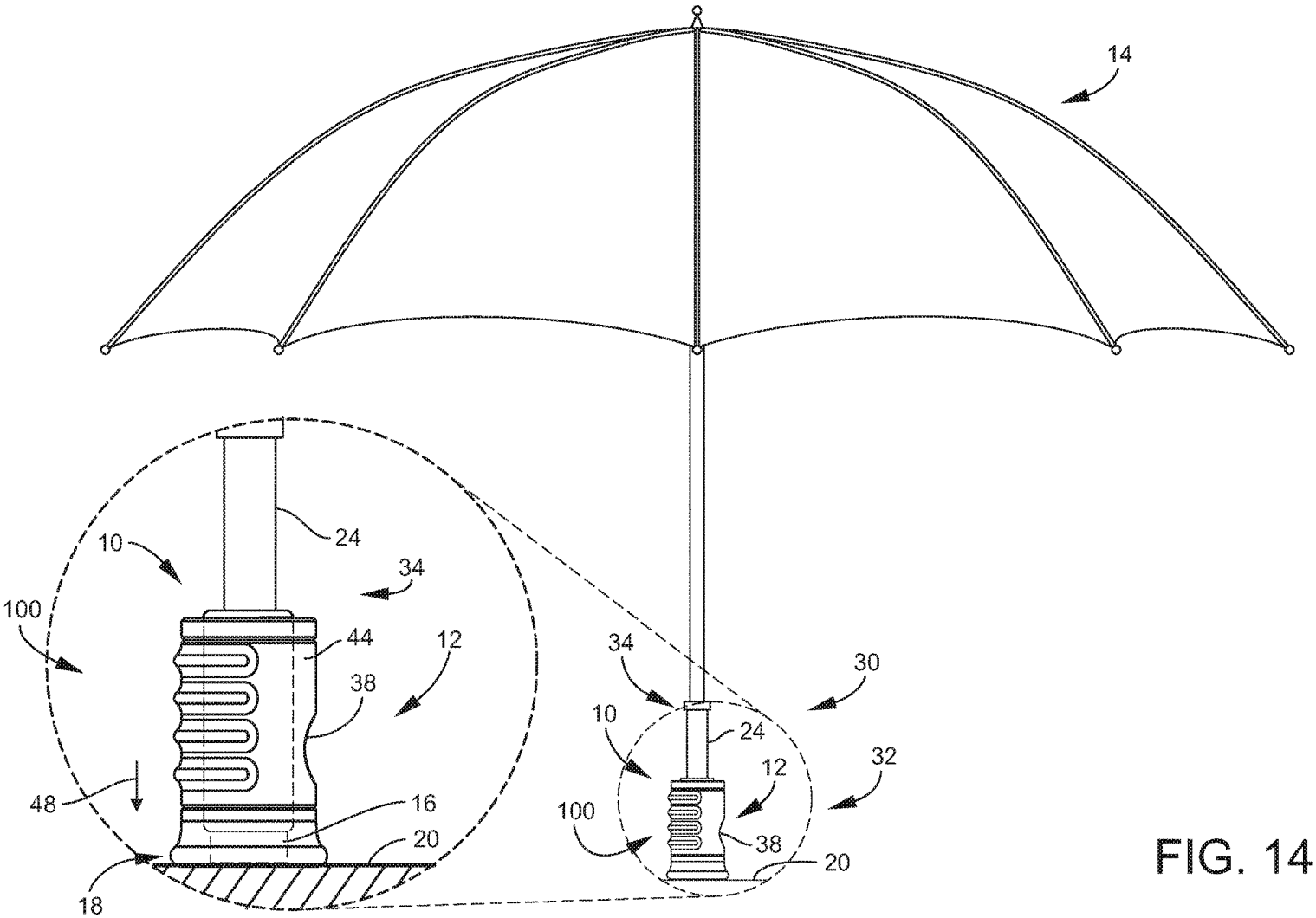
FIG. 14 is an environmental side view of the magnetic umbrella holder according to select embodiments of the instant disclosure holding an umbrella with a straight or pole handle.
Figure 15:
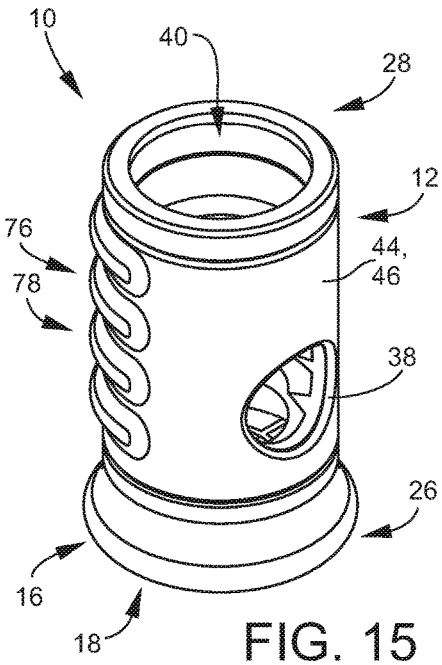
FIG. 15 is a top perspective side view of the magnetic umbrella holder according to select embodiments of the instant disclosure.
Figure 16:
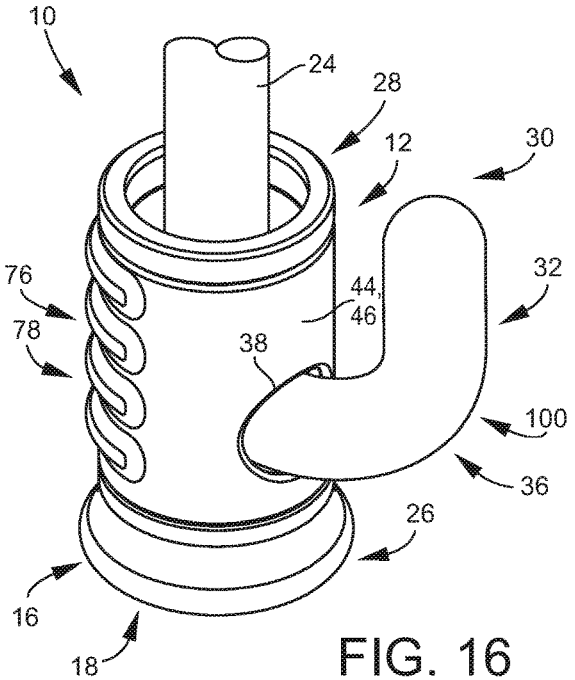
FIG. 16 is a top perspective side view of the magnetic umbrella holder of FIG. 15 holding an umbrella with a crook handle.
Figure 17:
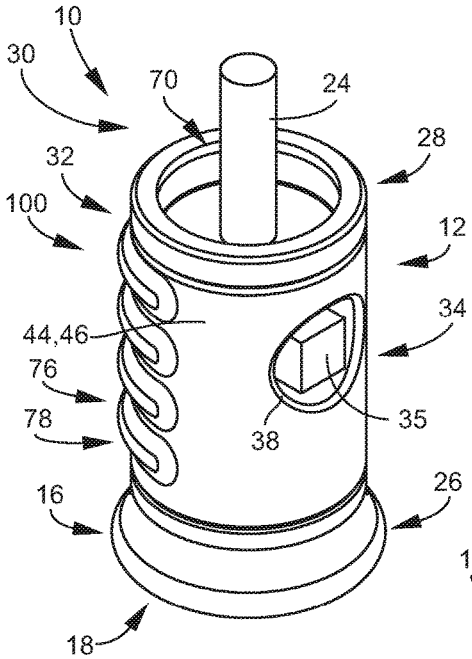
FIG. 17 is a top perspective side view of the magnetic umbrella holder of FIG. 15 holding an umbrella with a straight handle with an automatic button positioned in the side hole.
Figure 18:
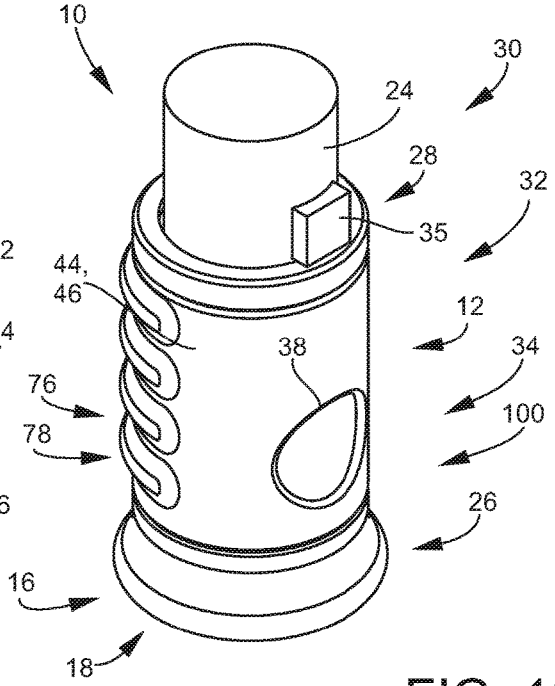
FIG. 18 is a top perspective side view of the magnetic umbrella holder of FIG. 15 holding an umbrella with a straight handle with an automatic button positioned outside of the base.

One feature of the instant magnetic umbrella holder 10 may be that open end 28 and hollow interior 22 may be sized and configured to receive and hold various size and shapes 32 of umbrella handles 24. In select embodiments, open end 28 and hollow interior 22 may be sized and configured to receive and hold various size and shapes 32 of pole shaped umbrella handles 34, as shown in FIGS. 14, 17, 18, and 19. In other select embodiments, open end 28 and hollow interior 22 may be sized and configured to receive and hold various size and shapes 32 of crook shaped umbrella handles 36, as shown in FIGS. 13 and 16. In other select embodiments, open end 28 and hollow interior 22 may be sized and configured to receive and hold various size and shapes 32 of pole shaped umbrella handles 34 and various size and shapes 32 of crook shaped umbrella handles 36, as shown in FIGS. 13, 14, 16, 17, 18 and 19.

Side hole 38 may be included in select embodiments of base 12 of magnetic umbrella holder 10. See FIGS. 1, 4, 5, 8. 9, 10, 11, 13, 14, 15, 16, 17, and 18. Side hole 38 may be designed for multiple purposes, including, but not limited to, for accepting the curve of crook shaped handles 36 (as shown in FIGS. 13 and 16), for accessing automatic button 35 of automatic umbrellas 14 with automatic button 35 positioned low on handle 24 (see FIG. 17), and combinations thereof. As such, side hole 38 may be sized and configured for receiving crook shaped umbrella handle 36. In addition, side hole 38 may also be sized and positioned for accessing automatic button 35 for automatic opening umbrellas 14 (see FIG. 17).

Hollow interior 22 of base 12 of magnetic umbrella holder 10 may be designed and configured for holding various size and shapes 32 of handles 24 of umbrella 14. In select embodiments of magnetic umbrella holder 10, hollow interior 22 of base 12 may have tubular shape 40, as shown in the Figures. Tubular shape 40 of hollow interior 22 may include any material and/or protrusions for gripping and holding handle 24 of umbrella 14 in base 12. In select embodiments, hollow interior 22 may include plurality of gripping ribs 42 inside tubular shape 40. Gripping ribs 42 may run radially around hollow interior 22 and may be longitudinally spaced from one another, as shown in FIGS.

1, 2, 4, 7, 8, 10, and 11. However, the disclosure is not so limited and gripping ribs 42 may be sized, spaced and oriented in any desired configuration for gripping various size and shapes 32 of handles 24 of umbrella 14.

Base 12 can be made from any desired material configured to hold handle 24 of umbrella 14. In select embodiments, as shown in the Figures, base 12 can be made from flexible material 44. Flexible material 44 may be configured to compress and hold various sizes or shapes 32 of umbrella handles 14. Hollow interior 22, including, gripping ribs 42 may be made from flexible material 33. Whereby, gripping ribs 42 may compress and hold various sizes or shapes 32 of umbrella handles 14 inside hollow interior 22 of base 12. As an example, and clearly not limited thereto, flexible material 44 may have hardness 46 of approximately or equal to 70 durometers. As examples, flexible material 44 of base 12 may be a flexible plastic, silicone, the like, or other like material. In select embodiments, base 12 may be made entirely of flexible material 44. In other select embodiments, hollow interior of base 12 may be made of flexible material 44 and an outer shell or the like of base 12 may surround the flexible material 44. In select embodiments, base 12 may be a cylindrical shaped device, as shown in the Figures. However the disclosure of base 12 is not so limited, and base 12 may take other shapes and forms for securing handle 24 of umbrella 14.

Magnet 16 may be designed and configured to hold magnetic umbrella holder 10 on magnetic surface 20 upright or perpendicular with umbrella 14 positioned therein. As such, magnet 16 may have pull force 48 (see FIGS. 13 and 14) configured to hold umbrella 14 perpendicular 30 on magnetic surface 20. Magnet 16 may include any shape or size of magnet configured with pull force 48 to hold umbrella 14 perpendicular or upright on magnetic surface 20, including, but not limited to, the puck shaped magnet 16 shown in FIGS. 1, 2, 7, 8, 10, 11, 13 and 14. In select embodiments, pull force 48 may be great enough to hold various sizes and shapes of umbrella 14 upright in the elements (wind, rain, etc.). In select embodiments of magnetic umbrella holder 10, magnet 16 may be positioned in bottom partition 50, as shown in FIGS. 1, 2, 7, 8, 10 and 11. Bottom partition 50 may be on top 52 of closed end 26 of base 12. Bottom partition 50 may be sized and configured to receive and hold magnet 16 on top 52 of closed end 26. As an example, when magnet 16 may be a puck shaped magnet, as shown in the Figures, bottom partition 50 may be a cylindrical shape configured to receive and hold the puck shaped magnet 16.

Figure 8:
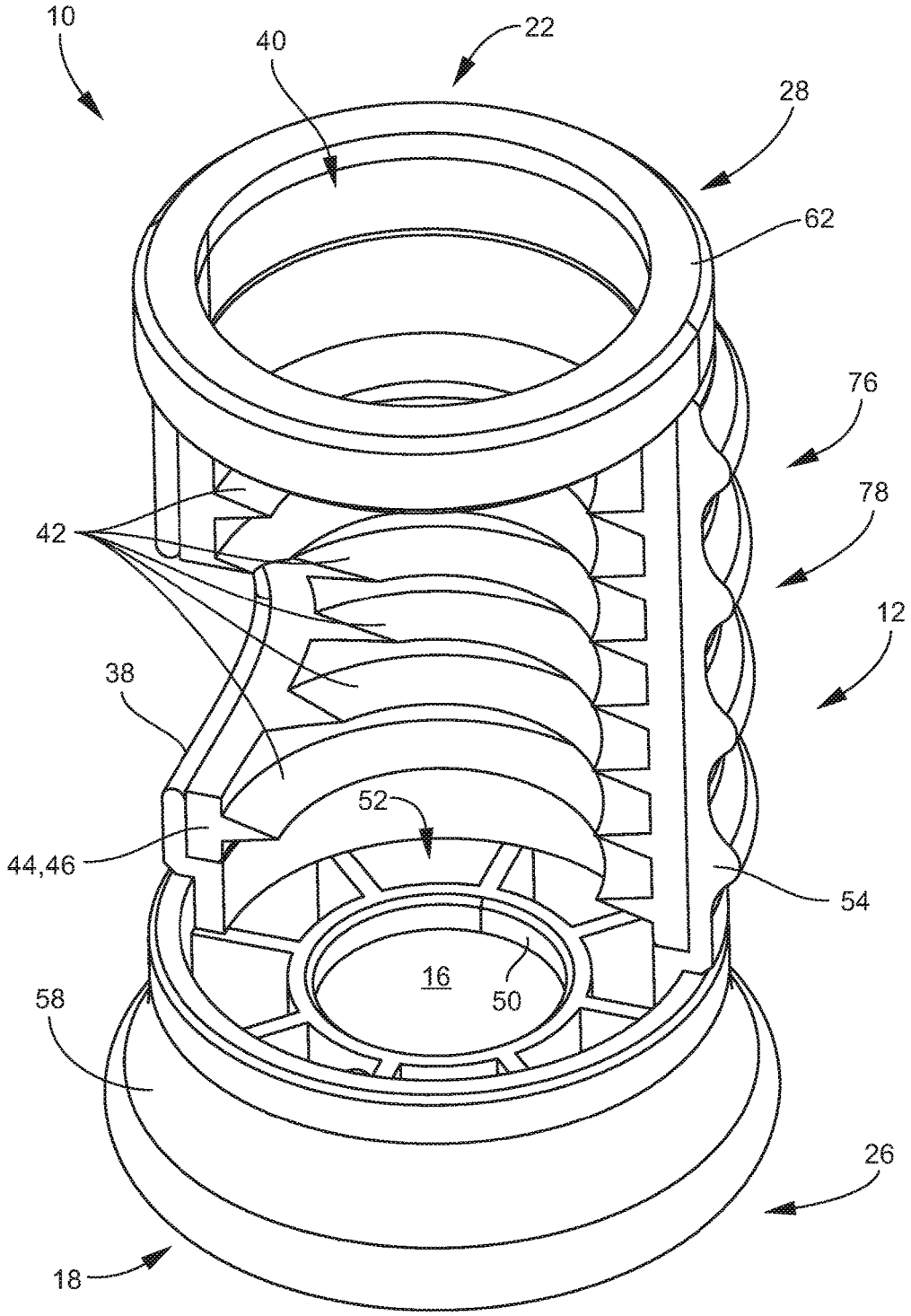
FIG. 8 is a partially broken away top perspective view of the magnetic umbrella holder from FIG. 1 showing the hollow interior.
Figure 9:
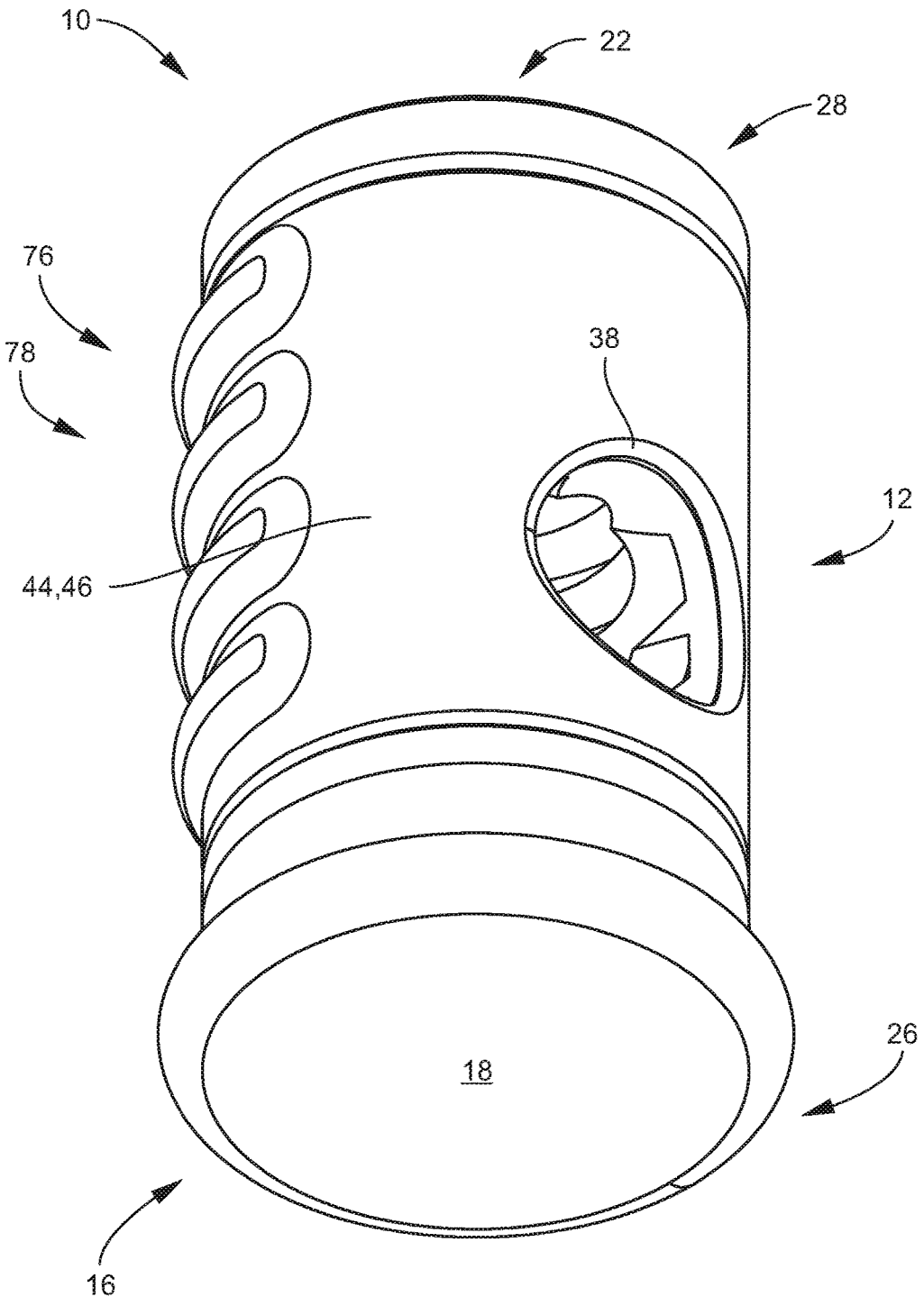
FIG. 9 is a bottom perspective view of the magnetic umbrella holder from FIG. 1.
Figure 10:
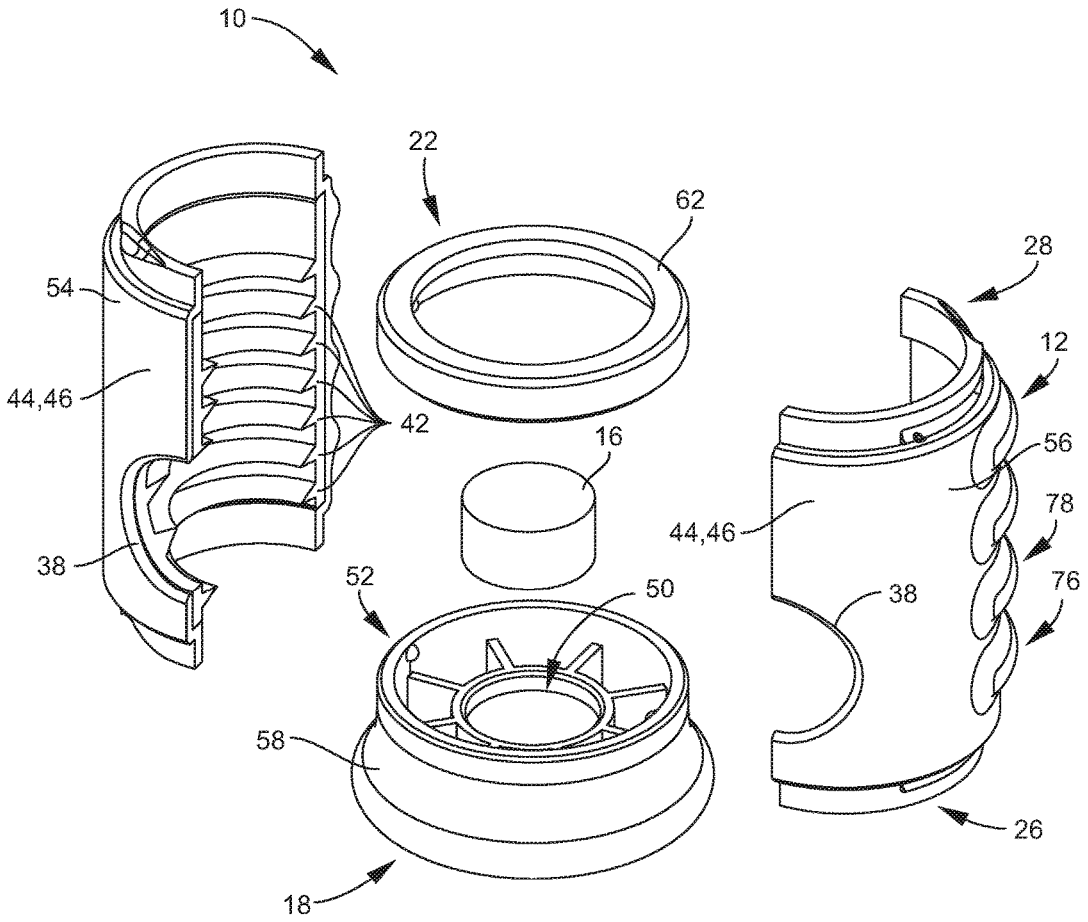
FIG. 10 is a partially disassembled view of the magnetic umbrella holder from FIG. 1.
Figure 11:
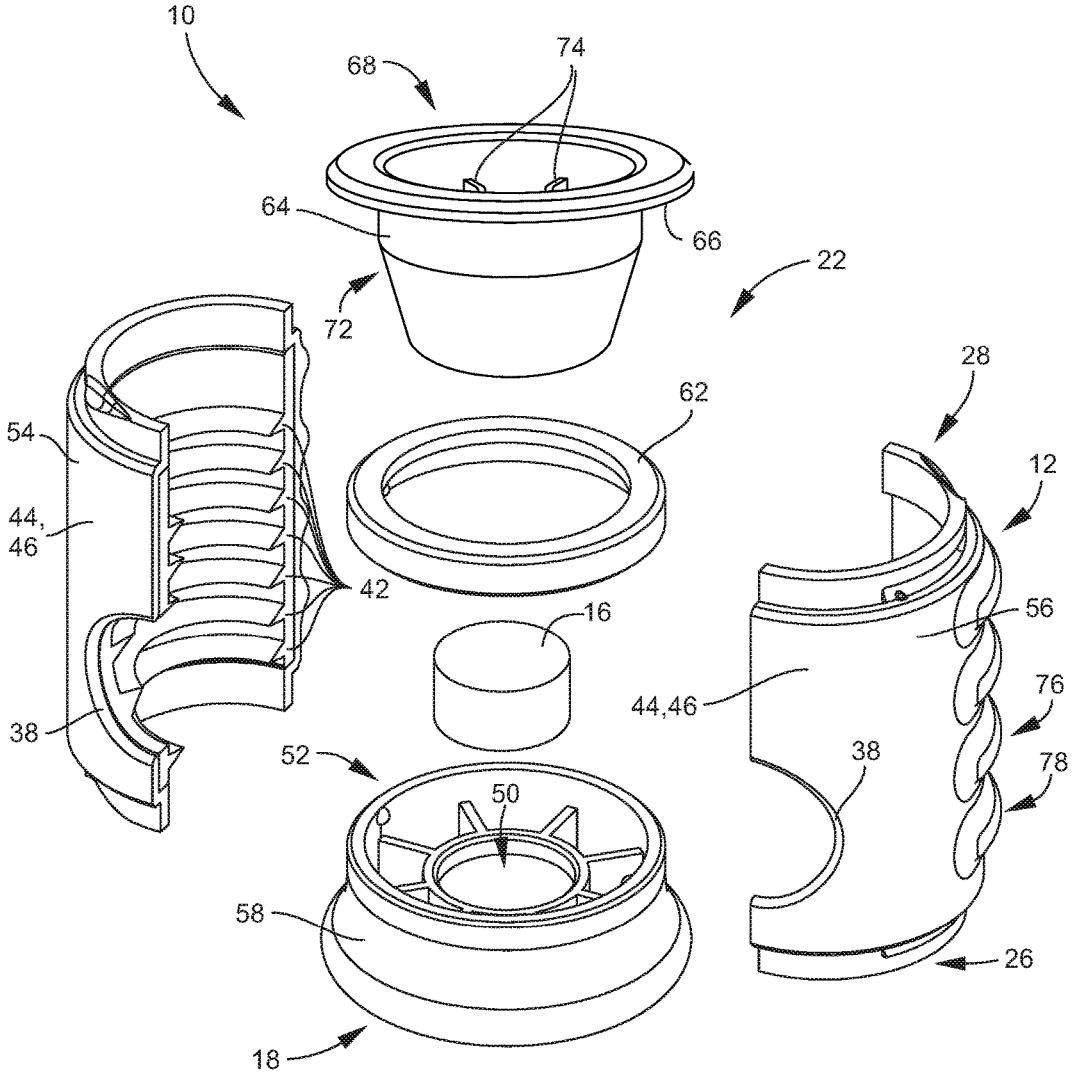
FIG. 11 is another partially disassembled view of the magnetic umbrella holder from FIG. 1 with the handle insert included.

Referring now to FIGS. 8, 10, and 11, in select embodiments of magnetic umbrella holder 10, base 12 may be a multi-piece base that is assembled together. However, the disclosure is not so limited, and base 12 may be integrally formed out of a single piece, including, out of a single piece of flexible material 44. As shown in FIGS. 8, 10 and 11, the multi-piece embodiment of base 12 may include first side piece 54, second side piece 56, bottom piece 58, and top ring 62. First side piece 54 and second side piece 56 may be configured to connect together where there interiors form hollow interior 22, as shown in the disassembled views of FIGS. 10 and 11. Bottom piece 58 may form closed end 26 on bottom 18 of base 12. Bottom piece 58 may include bottom partition 50 configured to receive and hold magnet 16 on top 52 of bottom piece 58. Bottom piece 58 may be configured to hold the bottoms of first side piece 54 and second side piece 56 together. Top ring 62 may be configured to form open end 28 on top of the connected first side piece 54 and second side piece 56. Top ring 62 may be configured to hold the tops of first side piece 54 and second side piece 56 together.

Figure 12:
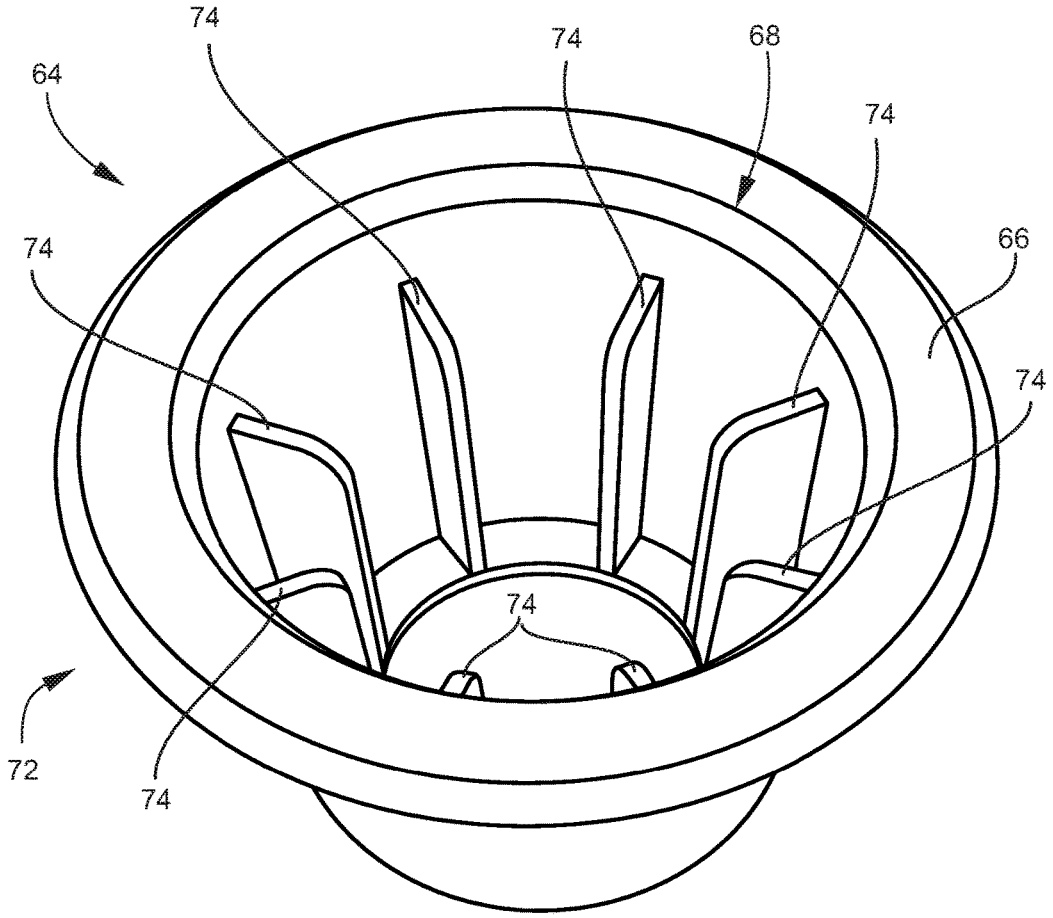
FIG. 12 is a top perspective view of the handle insert for the magnetic umbrella holder according to select embodiments of the instant disclosure.

Referring now specifically to the embodiments shown in FIGS. 11 and 12, another feature of the instant magnetic umbrella holder 10 may be the inclusion of removable handle insert 64. Handle insert 64 may be configured to be removably inserted into open end 28 of base 12. Handle insert 64 may include lip 66 configured to rest on open end 28 of base 12, like on top ring 62. In select embodiments, handle insert 64 may include tapered interior 68 with longitudinal ribs 74 configured to grip handles 24. In other select embodiments, handle insert 64 may include reduced interior 68 configured to hold smaller handles 70 than hollow interior 22 of base 12. In other select embodiments, handle insert 64 may be configured to hold crook shaped handles 36.

Referring now specifically to FIGS. 1, 4, 5, 6, 7, 8, 9, 10, 11, 13, 14, 15, 16, 17, and 18, another feature of magnetic umbrella holder 10 may be that, in select embodiments, base 12 may include exterior 76 with grips 78. Grips 78 may be configured for gripping base 12 for transportation and/or removal from magnetic surface 20. Exterior 76 may be any desired shape or configuration for magnetic umbrella holder 10.

Referring now specifically to FIGS. 13, 14, 16, 17, 18, and 19, in another aspect, the instant disclosure embraces magnetic umbrella handle 100. Magnetic umbrella handle 100 may include umbrella handle 24 with magnet 16 permanently built into its bottom, or it may include magnetic umbrella holder 10 inserted over the end of the umbrella handle 24 for providing magnet 16 at the bottom of umbrella handle 24. In other words, magnetic umbrella handle 100 may include magnet 16 built into the end of handle 24, or magnetic umbrella handle 100 may have magnet 16 removably connected to the end of handle 24 via magnetic umbrella holder 10. As such, magnetic umbrella handle 100 may generally include handle 24 attached to umbrella 14 configured for holding umbrella 14, and magnet 16 positioned at a bottom of handle 24. Magnet 16 may be configured to hold handle 24 perpendicular to magnetic surface 20. Wherein, magnetic umbrella handle 100 may be configured for positioning umbrella 14 perpendicular or upright on magnetic surface 20. Whereby, when umbrella 14 is positioned on magnetic surface 20, magnetic umbrella handle 100 may hold umbrella 14 perpendicular on magnetic surface 20.

One feature of magnetic umbrella handle 100 may be that the magnet 16 can have pull force 48 configured to hold umbrella 14 perpendicular or upright on magnetic surface 20.

Another feature of magnetic umbrella handle 100 may be that handle 24 can include exterior 76 with grips 78 configured for gripping handle 24 for transportation and removal from magnetic surface 20.

Figure 20:
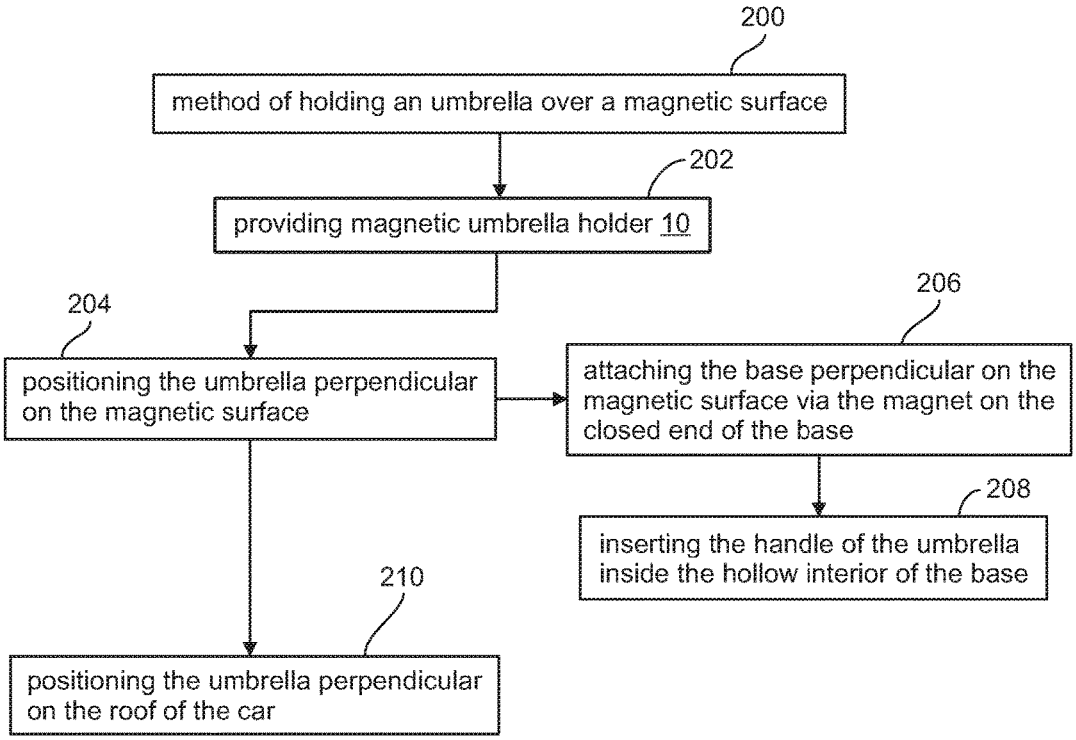
FIG. 20 is a flow diagram of the method of holding an umbrella over a magnetic surface according to select embodiments of the instant disclosure.

Referring now to FIG. 20, in yet another aspect, the instant disclosure embraces method 200 of holding umbrella 24 over magnetic surface 20. Method 200 may generally include step 202 of providing magnetic umbrella holder 10 in any of the various embodiments shown and/or described herein. As such, the provided magnetic umbrella holder 10 may generally include base 12 and magnet 16. Base 12 may be configured to hold umbrella 14. Magnet 16 may be positioned at bottom 18 of base 12. Magnet 16 may be configured to hold base 12 perpendicular or upright to magnetic surface 20. Base 12 may include hollow interior 22, closed end 26, and open end 28. Hollow interior 22 may be configured to hold handle 24 of umbrella 14. Closed end 26 may house magnet 16. Open end 28 may be configured for allowing handle 24 of umbrella 14 to be inserted inside hollow interior 22. As a result of the provided magnetic umbrella holder 10, method 200 may include step 204 of positioning umbrella 14 perpendicular or upright on magnetic surface 20. In select embodiments of method 200 of holding umbrella 14 over magnetic surface 20, step 204 of positioning umbrella 14 perpendicular or upright on magnetic surface 20 may include the steps of: step 206 of attaching base 12 perpendicular or upright on magnetic surface 20 via magnet 16 on closed end 26 of base 12; and step 208 of inserting handle 24 of umbrella 14 inside hollow interior 22 of base 12 via open end 28.

Method 200 may include holding umbrella 14 over any magnetic surface 20, like any metal surface. Referring specifically to FIG. 19, in other select embodiments of method 200 of holding umbrella 14 over magnetic surface 20, wherein magnetic surface 20 is the roof of a car, whereby step 204 of positioning umbrella 14 perpendicular or upright on magnetic surface 20 may include step 210 of positioning umbrella 14 perpendicular on the roof of the car. This may include positioning umbrella 14 over the driver's door for entering and exiting of the driver's seat of the vehicle, as shown in FIG. 19. However, the disclosure is not so limited, and the magnetic umbrella holder 10 with umbrella 14 secured therein may be positioned anywhere on the roof of the car, like for other passenger's entering and exiting their respective doors, for loading and unloading groceries, luggage or the lie, or for securing a baby, infant or child in their respective seat.

In use, the present disclosure functions as a holder for an umbrella of several different sizes and shapes, and will be able to be attached to any magnetic or metal surface to protect users from precipitation and/or sunlight. The device will have magnet 16 attached to the bottom of the base handle. The user will then insert the handle of the umbrella into the device and the device is now ready to be used on any metal surface. The device can be used, but is not limited to, when entering/exiting a vehicle, attached to the trunk of a car while inserting/removing items, and also placed on the hood/side fender of the car while changing a tire in the rain.

A feature of the present disclosure is its ability to hold an umbrella freely using the holder's ability to attach to a magnetic or metal surface.

Another feature of the present disclosure is its ability to provide convenience for users to protect them from precipitation, when paired with an umbrella Another feature of the present disclosure is its ability to use any umbrella of choice to be accompanied with the device for functionality.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A magnetic umbrella holder comprising:

a base configured to hold an umbrella; and a magnet positioned at a bottom of the base, said magnet is configured to hold the base on a magnetic surface;

the base comprising:

a hollow interior configured to hold a handle of the umbrella;

a closed end housing the magnet; and an open end configured for allowing the handle of the umbrella to be inserted inside the hollow interior;

wherein the magnetic umbrella holder is configured for positioning the umbrella on the magnetic surface;

whereby, when the umbrella is inserted into the base and the base is positioned perpendicular or upright on the magnetic surface, the magnetic umbrella holder holds the umbrella perpendicular or upright on the magnetic surface;

wherein the open end and hollow interior are configured to receive and hold various sizes and shapes of umbrella handles;

wherein the open end and hollow interior are configured to receive and hold pole shaped umbrella handles, crook shaped umbrella handles, and combinations thereof;

wherein the base including a side hole configured for receiving a crook shaped umbrella handle.

2. The magnetic umbrella holder of claim 1, wherein the hollow interior of the base having a tubular shape with a plurality of gripping ribs, said gripping ribs running radially around the hollow interior and being longitudinally spaced from one another.

3. The magnetic umbrella holder according to claim 2, wherein the base is made from a flexible material configured to compress and hold various size or shaped umbrella handles, wherein the flexible material having a hardness of approximately or equal to 70 durometers.

4. The magnetic umbrella holder of claim 1, wherein the magnet has a pull force configured to hold the umbrella perpendicular or upright on the magnetic surface.

5. The magnetic umbrella holder of claim 1, wherein the magnet is positioned in a bottom partition on a top of the closed end of the base, said bottom partition is sized to receive and hold the magnet on the top of the closed end.

6. The magnetic umbrella holder of claim 1, wherein the base includes:

a first side piece;

a second side piece;

the first side piece and the second side piece are configured to connect together to form the hollow interior;

a bottom piece forming the closed end on a bottom of the base, said bottom piece including a bottom partition configured to receive and hold the magnet on a top of the bottom piece; and a top ring configured to form the open end on a top of the connected first side piece and second side piece.

7. The magnetic umbrella holder of claim 1 further comprising:

a handle insert configured to be removably inserted into the open end of the base; and said handle insert including a lip configured to rest on the open end of the base.

8. The magnetic umbrella holder of claim 7, wherein:

the handle insert including a tapered interior with longitudinal ribs configured to grip the handles;

said handle insert including a reduced interior configured to hold smaller handles than the hollow interior of the base;

said handle insert being configured to hold crook shaped handles; or combinations thereof.

9. The magnetic umbrella holder of claim 1, wherein the base including an exterior with grips configured for gripping the base for transportation and removal from the magnetic surface.

10. A magnetic umbrella holder comprising:

a base configured to hold an umbrella; and a magnet positioned at a bottom of the base, said magnet is configured to hold the base on a magnetic surface;

the base comprising:

a hollow interior configured to hold a handle of the umbrella;

a closed end housing the magnet; and an open end configured for allowing the handle of the umbrella to be inserted inside the hollow interior;

wherein the magnetic umbrella holder is configured for positioning the umbrella on the magnetic surface;

wherein the base includes:

a first side piece;

a second side piece;

the first side piece and the second side piece are configured to connect together to form the hollow interior;

a bottom piece forming the closed end on a bottom of the base, said bottom piece including a bottom partition configured to receive and hold the magnet on a top of the bottom piece; and a top ring configured to form the open end on a top of the connected first side piece and second side piece.

11. The magnetic umbrella holder of claim 10, whereby, when the umbrella is inserted into the base and the base is positioned perpendicular or upright on the magnetic surface, the magnetic umbrella holder holds the umbrella perpendicular or upright on the magnetic surface.

12. The magnetic umbrella holder according to claim 11, wherein the open end and hollow interior are configured to receive and hold various sizes and shapes of umbrella handles.

13. The magnetic umbrella holder of claim 12, wherein the open end and hollow interior are configured to receive and hold pole shaped umbrella handles, crook shaped umbrella handles, and combinations thereof.

14. The magnetic umbrella holder of claim 13, wherein the base including a side hole configured for receiving a crook shaped umbrella handle.

15. The magnetic umbrella holder of claim 10, wherein the hollow interior of the base having a tubular shape with a plurality of gripping ribs, said gripping ribs running radially around the hollow interior and being longitudinally spaced from one another.

16. A magnetic umbrella holder comprising:

a base configured to hold an umbrella; and a magnet positioned at a bottom of the base, said magnet is configured to hold the base on a magnetic surface;

the base comprising:

a hollow interior configured to hold a handle of the umbrella;

a closed end housing the magnet; and an open end configured for allowing the handle of the umbrella to be inserted inside the hollow interior;

wherein the magnetic umbrella holder is configured for positioning the umbrella on the magnetic surface;

a handle insert configured to be removably inserted into the open end of the base;

said handle insert including a lip configured to rest on the open end of the base;

wherein:

the handle insert including a tapered interior with longitudinal ribs configured to grip the handles;

said handle insert including a reduced interior configured to hold smaller handles than the hollow interior of the base;

said handle insert being configured to hold crook shaped handles; or combinations thereof.

17. The magnetic umbrella holder of claim 16, whereby, when the umbrella is inserted into the base and the base is positioned perpendicular or upright on the magnetic surface, the magnetic umbrella holder holds the umbrella perpendicular or upright on the magnetic surface.

18. The magnetic umbrella holder according to claim 17, wherein the open end and hollow interior are configured to receive and hold various sizes and shapes of umbrella handles.

19. The magnetic umbrella holder of claim 18, wherein the open end and hollow interior are configured to receive and hold pole shaped umbrella handles, crook shaped umbrella handles, and combinations thereof.

20. The magnetic umbrella holder of claim 19, wherein the base including a side hole configured for receiving a crook shaped umbrella handle.

* * * * *